US009243633B2

(12) United States Patent
Schunk et al.

(10) Patent No.: US 9,243,633 B2
(45) Date of Patent: Jan. 26, 2016

(54) DEVICE FOR BRANCHING OFF A FLUIDIC PARTIAL FLOW

(75) Inventors: Andreas Schunk, Waldmohr (DE); Frank Hiery, Ensdorf (DE); Helmut Mertens, Riegelsberg (DE)

(73) Assignee: HYDAC FILTERTECHNIK GMBH, Sulzbach/Saar (DE)

( * ) Notice: Subject to any disclaimer, the term of this patent is extended or adjusted under 35 U.S.C. 154(b) by 1021 days.

(21) Appl. No.: 12/998,097

(22) PCT Filed: Sep. 24, 2009

(86) PCT No.: PCT/EP2009/006900

§ 371 (c)(1),
(2), (4) Date: Mar. 17, 2011

(87) PCT Pub. No.: WO2010/034491

PCT Pub. Date: Apr. 1, 2010

(65) Prior Publication Data

US 2011/0165008 A1 Jul. 7, 2011

(30) Foreign Application Priority Data

Sep. 27, 2008 (DE) ..... 10 2008 049 217

(51) Int. Cl.
*F04C 15/06* (2006.01)
*F04C 2/344* (2006.01)
*F04C 18/344* (2006.01)

(52) U.S. Cl.
CPC ..... *F04C 15/06* (2013.01); *F04C 2/344* (2013.01); *F04C 2/3442* (2013.01); *F04C 18/3442* (2013.01)

(58) Field of Classification Search
CPC ..... F04C 2/344; F04C 2/348; F04C 15/0023; F04C 18/344; F04C 18/3442
USPC ..... 418/236, 239, 268
See application file for complete search history.

(56) References Cited

U.S. PATENT DOCUMENTS

| | | | | |
|---|---|---|---|---|
| 2,639,855 | A | 5/1953 | Daniels | |
| 2,736,267 | A | 2/1956 | Mosbacher | |
| 3,128,707 | A | 4/1964 | Brundage | |
| 3,228,345 | A * | 1/1966 | Brundage | 418/15 |

(Continued)

FOREIGN PATENT DOCUMENTS

| | | |
|---|---|---|
| CH | 361 718 | 4/1962 |
| DE | 21 14 202 C3 | 10/1971 |

(Continued)

*Primary Examiner* — Devon Kramer
*Assistant Examiner* — Patrick Hamo
(74) *Attorney, Agent, or Firm* — Wenderoth, Lind & Ponack, L.L.P.

(57) ABSTRACT

A device for branching a fluidic partial flow off a main flow by a hydraulic pump (10) includes individual main chambers (12, 14, 16, 18, 20) sealed from each other and divided into functional groups, and operates according to the displacement principle. The chambers enable fluid from at least one main flow inlet (22) to be transported from an inlet or suction side to an outlet or pressure side of the hydraulic pump (10) and then via at least one main flow outlet. At least one independent partial chamber (26) is provided for the transport of the partial flow in addition to the main chambers (12, 14, 16, 18, 20). The partial chamber forms part of the pressure side of the hydraulic pump (10) and is connected to an independent partial current outlet (42) separate from the main flow inlet (22) and the main flow outlet (24).

13 Claims, 4 Drawing Sheets

(56) References Cited

U.S. PATENT DOCUMENTS

| | | | | |
|---|---|---|---|---|
| 3,241,747 | A | 3/1966 | Mihalakis et al. | |
| 3,242,867 | A | 3/1966 | Mosbacher | |
| 7,770,388 | B2 * | 8/2010 | Desai | 60/420 |
| 8,403,646 | B2 * | 3/2013 | Yoshinami | 417/2 |

FOREIGN PATENT DOCUMENTS

| | | | | |
|---|---|---|---|---|
| EP | 1 394 416 | A2 | 3/2004 | |
| WO | WO9630104 | A1 * | 10/1996 | B01D 35/26 |

* cited by examiner

DEVICE FOR BRANCHING OFF A FLUIDIC PARTIAL FLOW

FIELD OF THE INVENTION

The invention relates to a device for branching off a fluidic partial flow from a main flow by a hydraulic pump working according to the displacement principle. The device has individual main chambers sealed off from one another and divided into functional groups by which fluid coming from at least one main flow inlet can be transported from the inlet side or suction side to the outlet side or pressure side of the hydraulic pump and further by at least one main flow outlet.

BACKGROUND OF THE INVENTION

Hydraulic pumps (see, e.g., DE 21 14 202 C3) of this type are known in the prior art in a plurality of embodiments. Generally, hydraulic pumps are used to convert mechanical energy in the form of torque and rotational speed into hydraulic energy with a definable volumetric flow and fluid pressure. Hydraulic pumps that work according to the displacement principle have individual chambers sealed in the pump housing. In these chambers fluid is transported from the inlet side of the pump, comprising a suction port, to the outlet side in the form of the pressure port. Since no direct connection is between the suction port and the pressure port, pumps according to the displacement principle are suitable especially for high fluid system pressures.

Depending on whether vanes or pistons are used for implementation of the displacement principle, gear pumps and spiral pumps are distinguished from the vane pumps as dictated by design. Vane pumps are distinguished from the radial and axial piston pumps. All these pumps, regardless of whether the displacement volume is kept constant or variable, the displaced volume commonly and certainly always relates only to a fluid flow that is to be delivered and that is hereinafter referred to as the main flow.

SUMMARY OF THE INVENTION

An object of the invention is to provide an improved device for branching of a fluidic partial flow from a main flow by a hydraulic pump such that the range of application of these devices with a hydraulic pump is expanded in a cost-effective manner.

This object is basically achieved by a device that enables the branching off of a fluidic partial flow from a main flow. For the transport of the partial flow, at least one independent partial chamber in addition to the main chambers is designed for conveyance of the main flow. The partial chamber is a component of the pressure side of the hydraulic pump and is connected to an independent partial flow outlet that is separated from the respective main flow inlet and the respective main flow outlet.

The branched-off partial flow from the main flow allows use of the partial flow for the most varied tasks. Both the fluid volume of the partial flow and its fluid pressure are definable depending on the design of the device. This fluidic partial flow can therefore be used independently of the main flow for the supply of individual fluidic consumers. Emergency supply of hydraulic components in the field of roll stabilization or emergency supply of steering assist systems in case of failure is also easily possible via the partial flow. Furthermore, the partial flow that is branched off from the main flow can be subjected to sensor checking, for example, can be analyzed for the degree of its fouling to obtain qualitative information about the main flow. Here, a plurality of applications in the most varied areas is possible.

In one especially preferred embodiment of the device according to the invention, the hydraulic pump is a vane pump. Preferably, the individual vanes of the vane pump are guided in a drivable rotor to be able to move lengthwise between an end position in the rotor and an enclosing wall of a stator. The enclosing wall limits the travel of the vanes to the outside such that for at least one part of the vanes, two opposite fluid spaces at a time between the vanes and the rotor and the stator are formed. As a result of the opposite fluid spaces, depending on their volumetric configuration for different applications, different pressure levels can be implemented by one device. This configuration also leads to further possibilities of adaptation to requirements of the hydraulic circuit for the main flow.

The device according to the invention, however, need not be limited to use in a vane pump. Essentially all hydraulic pumps can be used here that work according to the displacement principle or a comparable principle.

The device according to the invention for partial flow formation with optionally definable volumetric portion, depending on the design of the device, is preferably made as a module that can be combined with other components such as, for example, drive units and/or filter units, with the formation of integral fluidic devices. The device can also be used as an individual module in complete systems such as for roll stabilization, steering support, etc., where independent partial volumetric flows are required for diverse control tasks and for emergency functions.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings that form a part of this disclosure and that are schematic and not to scale.

DETAILED DESCRIPTION OF THE INVENTION

Figure 1:
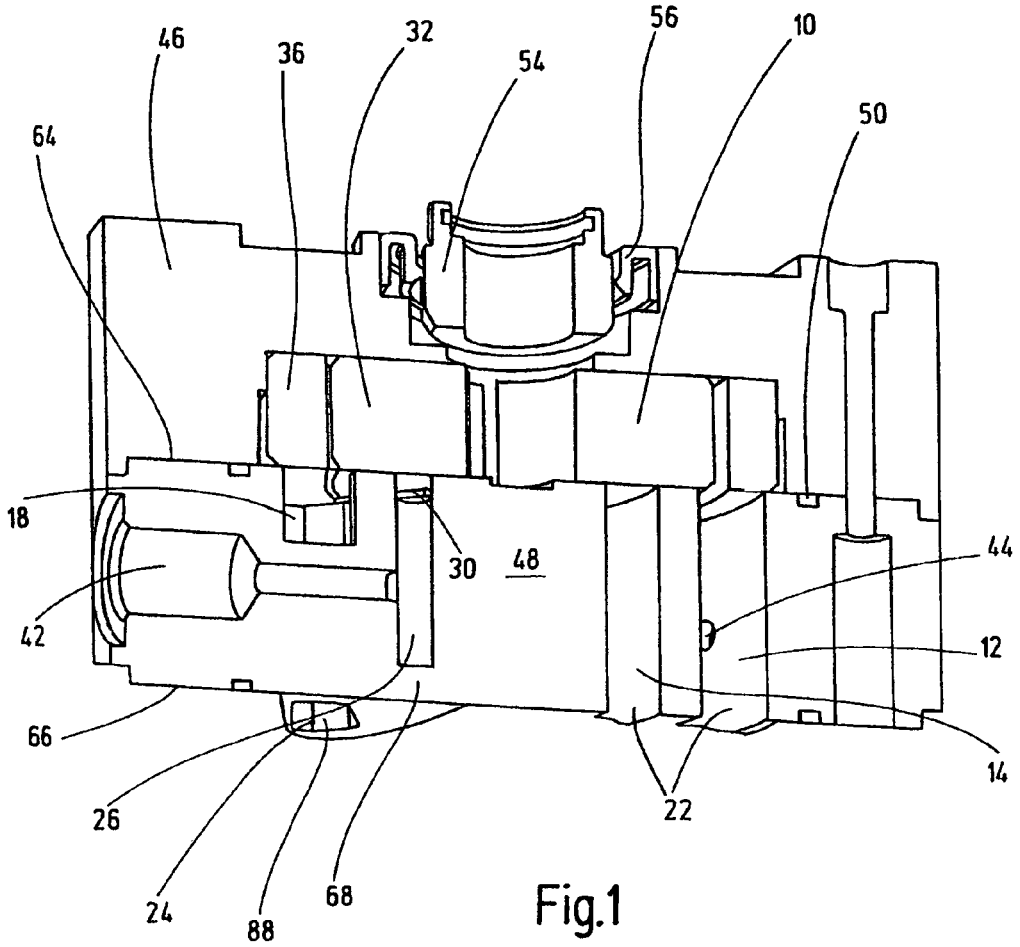
FIG. 1 is a side elevational view in section of essential components of a device according to an exemplary embodiment of the invention, the bottom edge of the figure being shown partially cut off for the sake of simplicity.
Figure 2:
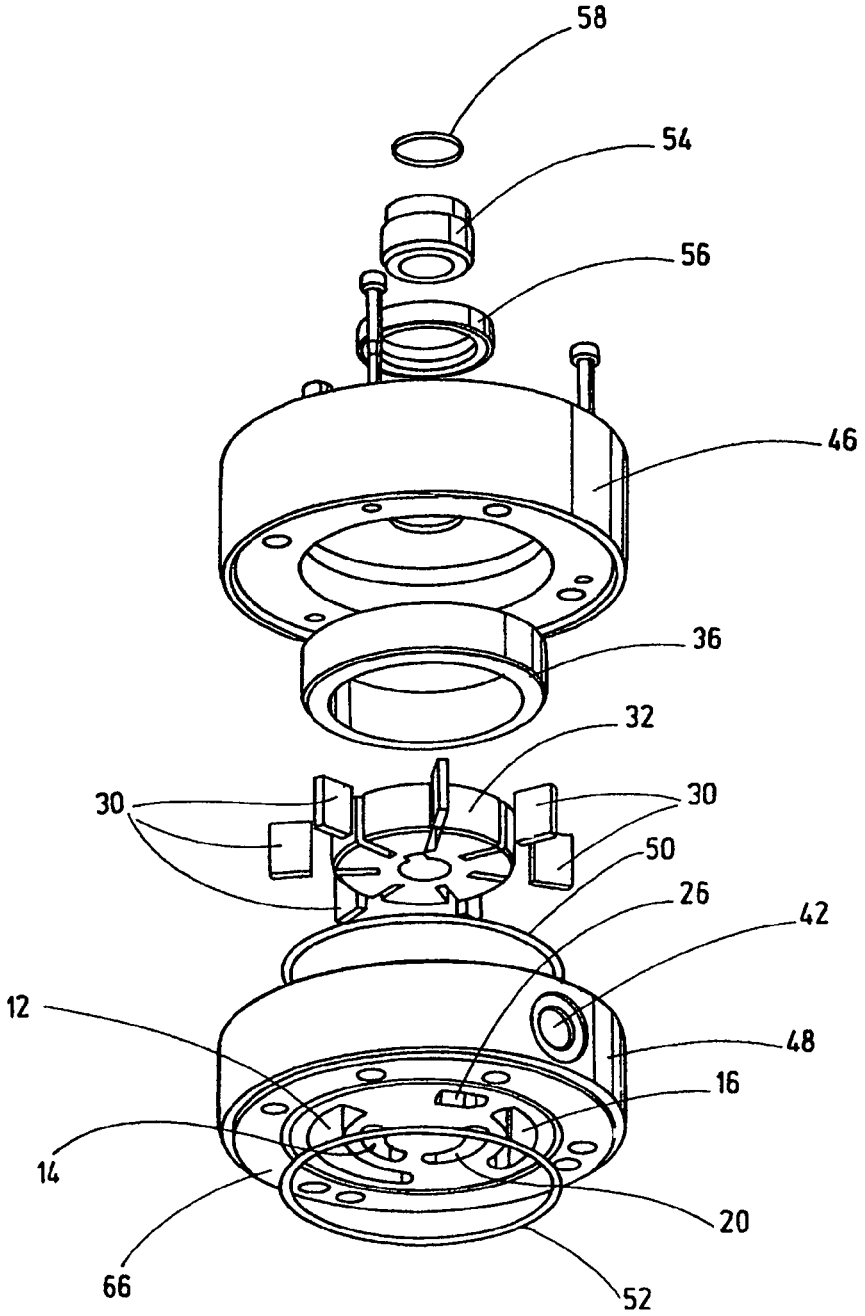
FIG. 2 is an exploded perspective view of the device of FIG. 1, but in a plane of the figure offset thereto.
Figure 3:
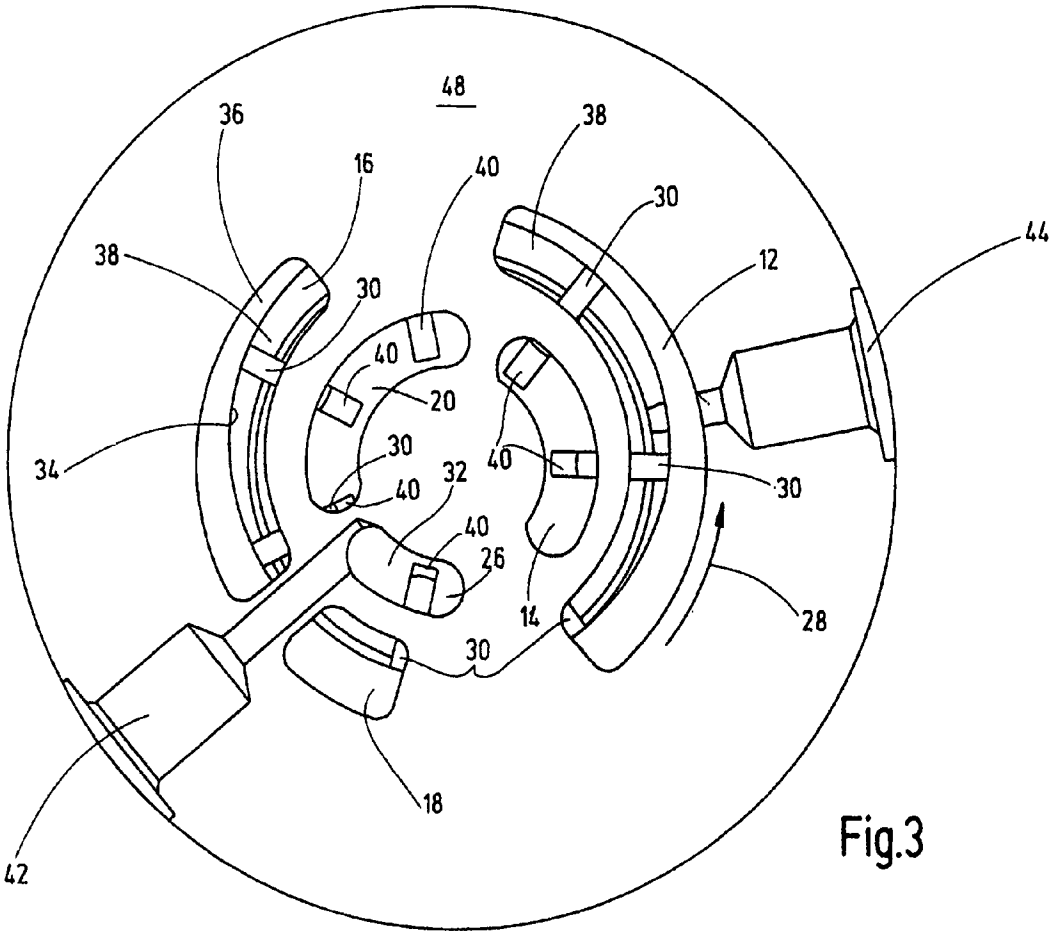
FIG. 3 is a bottom plan view of the chamber block of the device of FIGS. 1 and 2.

The device shown in FIGS. 1 to 3 is used for branching off a fluidic partial flow from a main flow by a hydraulic pump 10 working according to the displacement principle. The pump 10 has individual chambers 12, 14, 16, 18, and 20 that are sealed off from one another. By those chambers, fluid can be transported from the inlet side or suction side to the outlet side or pressure side of the hydraulic pump 10.

For the partial flow to be branched off, an independent partial chamber 26 is a component of the pressure side of the hydraulic pump 10 together with the third chamber 16, the fourth chamber 18, and the fifth chamber 20. The first chamber 12 and the second chamber 14 are assigned to the suction side.

In the present case, the hydraulic pump 10 is a vane pump whose direction of rotation is shown with an arrow 28 in FIG. 3. The individual vanes 30 of the vane pump are guided in a drivable rotor 32 to be able to move lengthwise between an end position in the rotor 32 and an enclosure wall 34 of a stator 36. Enclosure wall 34 limits the travel of the vanes 30 to the outside such that for the vanes 30 two opposite fluid spaces 38, 40 at a time are formed between them and the rotor 32 and the stator 36.

As further follows from FIG. 3, viewed in the direction of rotation, the right fluid space 38 and the fluid spaces 40 widen and thus apply a suction action to the main fluid volumetric flow with inclusion of the individual chambers 12 and 14. Conversely, viewed in the direction of FIG. 3, in the direction of rotation of the vane pump, the fluid spaces 38 and 40 taper relative to the chambers 16, 18, and 20 so that the main flow travels to the outlet side or pressure side with a definable pressure level. This displacement principle is known in connection with vane pumps and comparable positive displacement pumps so that it will not be further detailed here. As a result of the individual chambers together with the fluid spaces 38 and 40 both on the suction side and on the pressure side for the individual chambers 12 relative to 14 as well as 16 and 18 relative to 20, a different paired pressure level can be set so that two main flows separated from one another could be triggerable by the device. In this exemplary embodiment, however, only one main fluid flow is conveyed jointly with the chambers 12, 14, 16, 18, and 20.

To form the fluidic partial flow, the partial chamber 26 used is separated in space from the other indicated chambers and has a separate partial flow outlet 42. The partial flow quantity is discharged via the indicated partial flow outlet 42 and is pushed out of the device by the respective vane 30 in the travel direction to the second fluid space 40. Since the vanes 30 cross the partial chambers 26 in direct succession, fluid is permanently discharged to the outside on the pressure side of the device via the partial flow outlet 42. In this exemplary embodiment, after supplying a hydraulic consumer, for performing an emergency function, or after passing through a sensor unit (not shown), the partial flow is brought to the suction side of the device and in turn delivered to the device via the partial flow inlet 44.

Overall, one part of the fluid spaces 38, 40 is assigned to the individual chambers 12, 14, 16, 18, and 20 of the suction side and the pressure side of the hydraulic pump 10 and that another part, formed by at least one of the fluid spaces 40, is assigned to the partial chamber 26 for partial flow formation. As the exploded drawing in FIG. 2 shows in particular, the stator 36 is formed from a hollow cylindrical ring accommodated in a housing 46 of the device. The rotor 32 with its individual vanes 30 is held eccentrically with its drive axis in the stator 36 for purposes of implementing the already described vane pump principle. The illustrated chambers 12, 14, 16, 18, 20, and 26 are in turn a component of an independent chamber block 48. For the sake of simplicity the fourth chamber 18 is not shown in FIG. 2. The chamber block 48 ends to the outside flush with the device housing 46 (compare FIG. 1) and is sealed accordingly to the inside in the direction of the stator 36 by a gasket 50. Another gasket 52 is on the side opposite the chamber block 48 for sealing of adjoining parts of the device.

Figure 4:
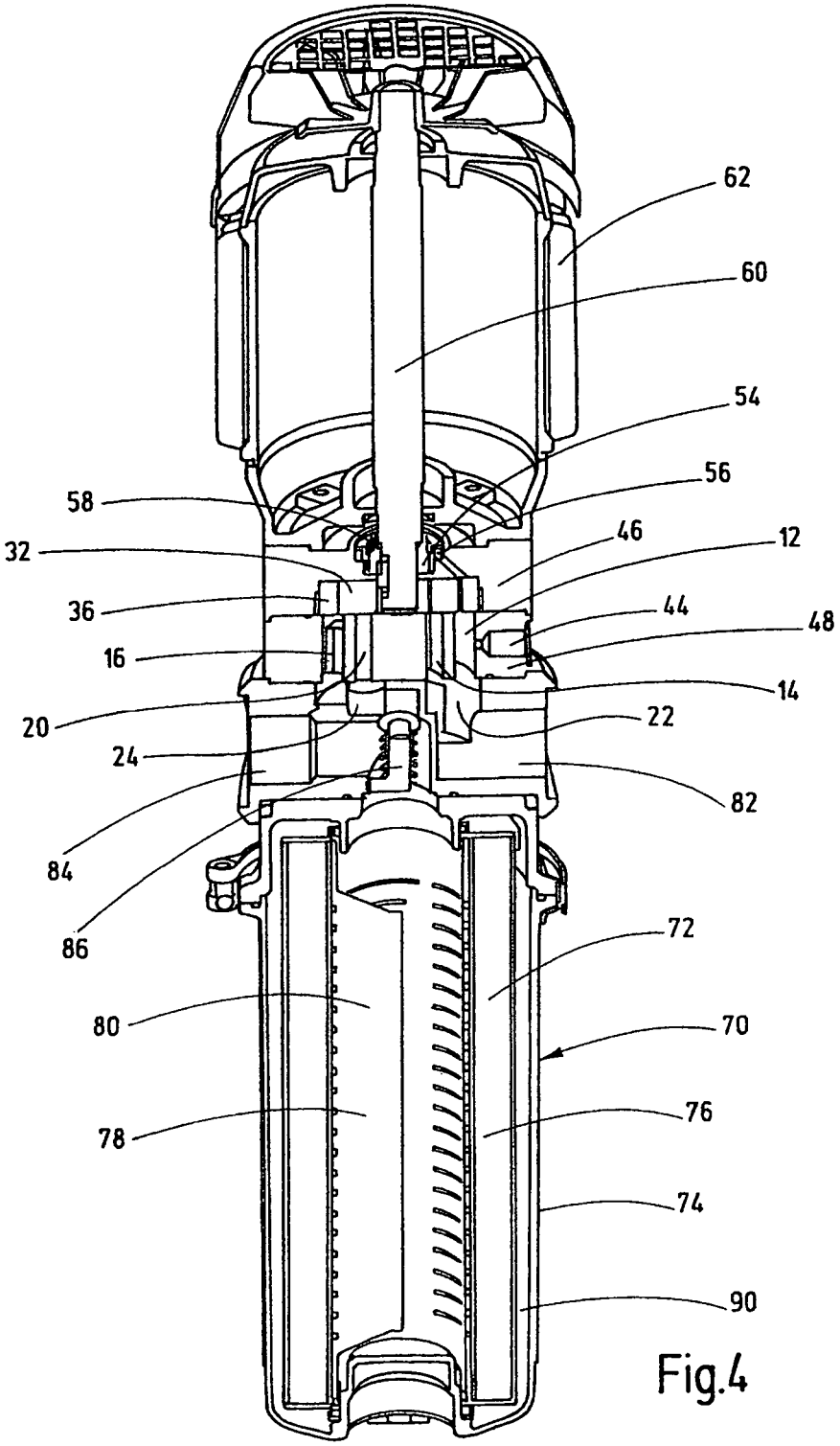
FIG. 4 is a perspective view in section of one possible application example for the device of FIGS. 1 to 3.

For driving the vane pump, a drive shaft 54 is used that is sealed to the outside by a chambered gasket 56, and by an independent gasket 58 relative to a drive shaft 60 of an electric motor 62 (compare FIG. 4). As illustrated in FIG. 2, the partial flow outlet 42 is shown offset in the plane of the figure by a pivot angle of approximately 120° compared to FIG. 1.

As the figures furthermore show, the chambers 12, 14, 16, 18, and 20 discharge from the suction side 22 and the pressure side 24 within the chamber block 48 to its two opposite face sides 64, 66 into the environment. The partial chamber 26 for partial flow formation, on its side facing away from the hydraulic pump 10 is closed to the outside by wall parts 68 of the chamber block 48 (FIG. 1). Furthermore, the individual chambers 12, 14, 16, 18, and 20 as well as 26 are arranged running in a concentric configuration to the drive axle (drive shaft 60) of the hydraulic pump and are otherwise made sickle-shaped. The first chamber 12 with the third and fourth chambers 16 and 18 forms the outer concentric ring. The second chamber 14 with the fifth chamber 20 and the partial chamber 26 lies on the inner concentric circular path around the drive axis. If other positive displacement pumps are to be used for the hydraulic pump 10, a different arrangement must be chosen. For separating the partial flow from the main flow, an independent branch chamber is necessary for this purpose with a separate outlet relative to the inlets and outlets for the main flow.

One exemplary embodiment for the application of the described device is shown below based on FIG. 4. Here, the device shown in FIGS. 1 and 3 is seated on a filter unit 70 of conventional design. The filter unit 70 has a replaceable filter element 72 in a filter housing 74. The filter mat 76 of the filter element 72 on the inner peripheral side is supported by a conventional support pipe 78 with inside walls 80 arranged in a star-shape. Furthermore, the filter unit 70 on its top has a fluid inlet 82 and a fluid outlet 84 that route the main flow. Furthermore, the filter unit 70 has a bypass device 86 that directly clears the fluid path between the device according to the invention and the fluid outlet 84 if the filter element 72 is blocked as a result of dirt.

Opposite the filter unit 70 and seated from above on the device according to the invention, the electric motor 62 is provided. For the sake of simplicity, the electrical winding of the motor has been omitted. The electric motor 62 drives the drive shaft 60. In the direction of FIG. 4, shaft 60 engages the rotor 32 of the vane pump with its bottom end in order to ensure its driving in this way. If the vane pump is being operated as a hydraulic pump 10, it intakes fluid via its suction side and therefore via a main flow inlet 22 via the fluid inlet 82. On the pressure side and therefore via the main flow outlet 24, the pertinent amount of fluid of the main flow is delivered via a passage site 88 (compare FIG. 1) into the fluid space 90 between the filter housing 74 and filter element 72. After flowing through the filter element 72 from the outside to the inside via the wall guide of the support pipe 78, the cleaned fluid is routed out of the device via the fluid outlet 84. At the same time, in this delivery operation for the main flow, secondary flow fluid is intaken via the partial flow inlet 44, for example, originating from a sensor device, and via the separate partial chamber 26 and the partial flow outlet 42 in turn relayed to the sensor device (not shown), for example, for determining the degree of fouling of one part of the fluid of the main flow.

The above described exemplary embodiment is only exemplary, and the device according to the invention can be used wherever a partial flow amount is required from a main flow. In this way, emergency functions in roll stabilization devices in the motor vehicle and/or steering assist devices can also be provided with partial flow fluid.

While one embodiment has been chosen to illustrate the invention, it will be understood by those skilled in the art that various changes and modifications can be made therein without departing from the scope of the invention as defined in the appended claims.

What is claimed is:

1. A device for branching of a fluidic partial flow from a main flow by a hydraulic displacement pump, comprising:

a hydraulic vane pump having a main flow inlet intaking fluid and a main flow outlet delivering pressurized fluid, said hydraulic vane pump including individual vanes guided for lengthwise movement in a drivable rotor between an end position in said rotor and an enclosing wall of a stator around said rotor, said enclosing wall limiting travel of said vanes in a radially outward direction with first and second opposite fluid spaces being between each of said vanes and said rotor and said stator, respectively;

a plurality of main chambers sealed off from one another in said hydraulic vane pump transporting fluid from said main flow inlet on a suction side to said main flow outlet on a pressure side of said hydraulic vane pump and transporting the fluid further by said main flow outlet, on each of said suction side and said pressure side at least two of said chambers being provided in one chamber block, one set of said main chambers being assigned to said first fluid space of each of said vanes, another set of said main chambers being assigned to said second fluid space of each of said vanes;

at least one partial chamber in said hydraulic vane pump independent of and in addition to said main chambers transporting a partial fluid flow, said at least one partial chamber being a component of the pressure side of said hydraulic vane pump and connected to a partial flow outlet of said hydraulic vane pump, said partial flow outlet being independent of and separated from said main flow inlet and said main flow outlet;

an electric motor coupled to and driving said hydraulic vane pump;

a filter unit having a filter housing with a top thereon directly and mechanically coupled to said hydraulic vane pump on a side thereof opposite said electric motor, said filter housing having a filter element therein; and a third fluid space between said filter housing and said filter element coupled by a passage on said pressure side to said main flow outlet delivering fluid from said main flow outlet to said third fluid space.

2. A device according to claim 1 wherein said chamber block comprises opposite first and second face sides to which said main chambers open on said suction side and said pressure side, respectively; and said at least one partial chamber is closed to an outside of said chamber block on a side thereof facing away from said hydraulic vane pump.

3. A device according to claim 1 wherein each of said chambers are sickle-shaped and extend concentrically to a drive shaft of said electric motor.

4. A device according to claim 1 wherein said partial flow outlet is connected to a hydraulic consumer that is in turn connected to said suction side of said hydraulic vane pump.

5. A device according to claim 1 wherein said partial flow outlet is connected to a sensor device that is in turn connected to said suction side of said hydraulic vane pump.

6. A device for branching of a fluidic partial flow from a main flow by a hydraulic displacement pump, comprising:

a hydraulic vane pump having a main flow inlet intaking fluid and a main flow outlet delivering pressurized fluid, said hydraulic vane pump including individual vanes guided for lengthwise movement in a drivable rotor between an end position in said rotor and an enclosing wall of a stator around said rotor, said enclosing wall limiting travel of said vanes in a radially outward direction with first and second opposite fluid spaces being between each of said vanes and said rotor and said stator, respectively;

a plurality of main chambers sealed off from one another in said hydraulic vane pump transporting fluid from said main flow inlet on a suction side to said main flow outlet on a pressure side of said hydraulic vane pump and transporting the fluid further by said main flow outlet, on each of said suction side and said pressure side at least two of said chambers being provided in one chamber block, one set of said main chambers being assigned to said first fluid space of each of said vanes, another set of said main chambers being assigned to said second fluid space of each of said vanes;

at least one partial chamber in said hydraulic vane pump independent of and in addition to said main chambers transporting a partial fluid flow, said at least one partial chamber being a component of the pressure side of said hydraulic vane pump and connected to a partial flow outlet of said hydraulic vane pump, said partial flow outlet being independent of and separated from said main flow inlet and said main flow outlet; and a filter unit coupled to said hydraulic vane pump, said filter unit having a filter housing and a filter element therein.

7. A device according to claim 6 wherein said chamber block comprises opposite first and second face sides to which said main chambers open on said suction side and said pressure side, respectively; and said at least one partial chamber is closed to an outside of said chamber block on a side thereof facing away from said hydraulic vane pump.

8. A device according to claim 6 wherein each of said chambers are sickle-shaped and extend concentrically to a drive shaft of an electric motor.

9. A device according to claim 6 wherein said partial flow outlet is connected to a hydraulic consumer that is in turn connected to said suction side of said hydraulic vane pump.

10. A device according to claim 6 wherein said partial flow outlet is connected to a sensor device that is in turn connected to said suction side of said hydraulic vane pump.

11. A device according to claim 2 wherein each of said chambers are sickle-shaped and extend concentrically to a drive shaft of said electric motor.

12. A device according to claim 2 wherein said partial flow outlet is connected to a hydraulic consumer that is in turn connected to said suction side of said hydraulic vane pump.

13. A device according to claim 2 wherein said partial flow outlet is connected to a sensor device that is in turn connected to said suction side of said hydraulic van pump.

* * * * *